US005163559A

United States Patent [19]

Bunin

[11] Patent Number: 5,163,559

[45] Date of Patent: Nov. 17, 1992

[54] CHILD RESISTANT UNIT DOSE PACKAGE AND SEPARATE DRUG CONTAINER

[75] Inventor: Leonid Bunin, Woodbridge, N.J.

[73] Assignee: Merck & Co., Inc., Rahway, N.J.

[21] Appl. No.: 810,254

[22] Filed: Dec. 19, 1991

Related U.S. Application Data

[63] Continuation-in-part of Ser. No. 597,644, Oct. 15, 1990, Pat. No. 5,082,114.

[51] Int. Cl.[5] ..... B65D 43/26; A61J 1/00

[52] U.S. Cl. ..... 206/532; 206/1.5; 206/539; 220/283

[58] Field of Search ..... 206/528-540, 206/1.5, 328, 807; 220/263-264, 281-283

[56] References Cited

U.S. PATENT DOCUMENTS

| | | | |
|---|---|---|---|
| 3,348,724 | 10/1967 | Rosso | 220/281 |
| 3,381,850 | 5/1968 | Haugen | 220/281 |
| 3,894,655 | 7/1975 | Mattheis et al. | 220/283 |
| 3,934,745 | 1/1976 | Lovell | 220/281 |
| 3,968,880 | 7/1976 | Ostrowsky | 220/281 |
| 4,133,449 | 1/1979 | Ostrowsky | 206/540 |
| 4,535,905 | 8/1985 | Sandhaus | 220/281 |
| 4,890,742 | 1/1990 | Allison | 206/1.5 |
| 5,042,472 | 8/1991 | Bunin | 206/539 |
| 5,054,642 | 10/1991 | Yoshida | 220/524 |

FOREIGN PATENT DOCUMENTS

| | | | |
|---|---|---|---|
| 0238451 | 5/1962 | Australia | 220/359 |
| 1115638 | 10/1961 | Fed. Rep. of Germany | 206/534.2 |
| 0202534 | 3/1966 | Sweden | 206/540 |

*Primary Examiner*—Jimmy G. Foster

*Attorney, Agent, or Firm*—Salvatore C. Mitri; Charles M. Caruso

[57] ABSTRACT

A child resistant unit dose package for medications comprises a container member having concealed locking means, a plurality of cavities along its longitudinal axis for holding medication, each cavity closed with a peel-off seal, and a cover for the container member that requires two operations to open. In another embodiment, a separate drug container is disclosed which does not include a cover.

12 Claims, 4 Drawing Sheets

CHILD RESISTANT UNIT DOSE PACKAGE AND SEPARATE DRUG CONTAINER

BACKGROUND OF THE INVENTION

This application is a continuation-in-part of co-pending application Ser. No. 597,644 filed Oct. 15, 1990 U.S. Pat. No. 5,082,114.

Many medications are dangerous if taken by children or if taken by children in excess. In order to prevent accidental ingestion of medications by children who encounter a medication container, it has been desirable to design medication containers that are resistant to being opened by children.

It has also been desirable to provide medication containers that are simple and easy to use by the elderly, the manually handicapped and those having limited or restricted manual dexterity, especially where there is no risk of accidental ingestion of the medications by children.

SUMMARY OF THE INVENTION

A child resistant unit dose package for medications comprises a longitudinal member having a plurality of cavities, each cavity adapted to hold a unit dosage medication, each cavity sealed after filling with a peel-off seal, and a cover for the container member that requires opening a concealed snap-lock and manually lifting the cover from the container member to expose the cavities. In other embodiments, the container member is provided without the cover.

BRIEF DESCRIPTION OF THE DRAWINGS

In FIG. 1 the package is closed. FIGS. 2 and 3 show the means of opening the package, and FIG. 4 shows it fully opened.

DETAILED DESCRIPTION

Figure 1:
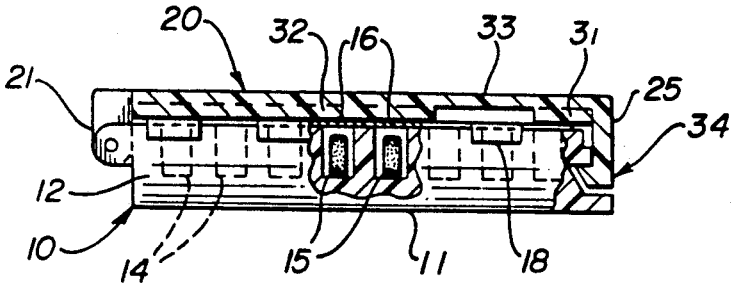
FIGS. 1, 2, 3 and 4 are midsectional side elevations along the longitudinal axis of the package of the present invention.

This invention relates to a child resistant unit dose package, and more particularly to such a package having concealed locking means wherein a two-step procedure is required to expose the cavities holding the medication.

This invention also relates to a drug container that does not have a locking cover and that is simple and easy to use.

The unit dose package and the drug container of the invention will become more apparent from the ensuing description when considered together with the figures of the drawing wherein like reference numerals identify like parts.

According to the present invention the child resistant unit dosage package consists of a container member 10 having a bottom surface 11 and sidewalls 12 and 13. Container member 10 is provided with a plurality of cavities or chambers 14. Each chamber is intended to hold a tablet 15, capsule, caplet or the like of single dose medication. The cavities are covered with a protective strip 16, e.g., an aluminum foil, heat sealable laminate, which is adhered to the top surfaces 17 of container member 10 by heat sealing and which is readily removed by peeling off to expose the medication. Foil 16 is provided with tabs 18 and scores 19 to facilitate opening of individual cavities by pulling the tabs.

Container member 10 is provided with cover 20 extending along substantially all of the length of member 10 and attached to member 10 by hinge means 21. Cover 20 has top 22 and sidewalls 23 and 24 that overlap the sidewalls 13 and 12, respectively, when the cover is closed. Cover 20 is provided at its front end with a downwardly projecting wall 25 that fits over the front wall 26 of container member 10. Walls 25 and 26 cooperate to form concealed locking means 34. In the embodiment shown, the locking means is formed by providing the bottom of the interior surface of wall 25 with a flange 27 adapted to fit over flange 28 provided on the outer surface of wall 26, thereby locking cover 20 to container member 10. When the package is closed the locking means are concealed.

Figure 2:
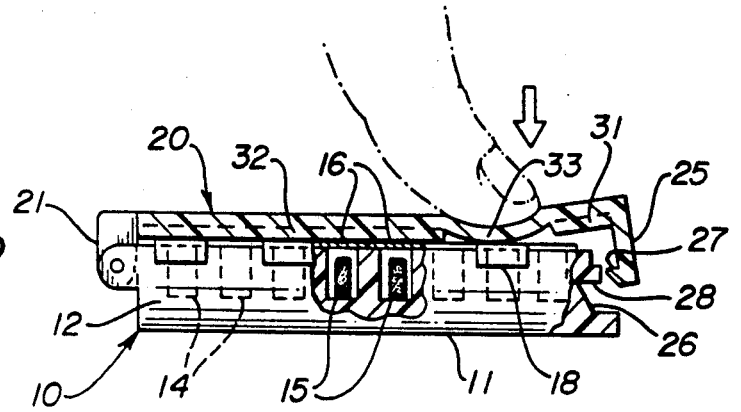
Figure 3:
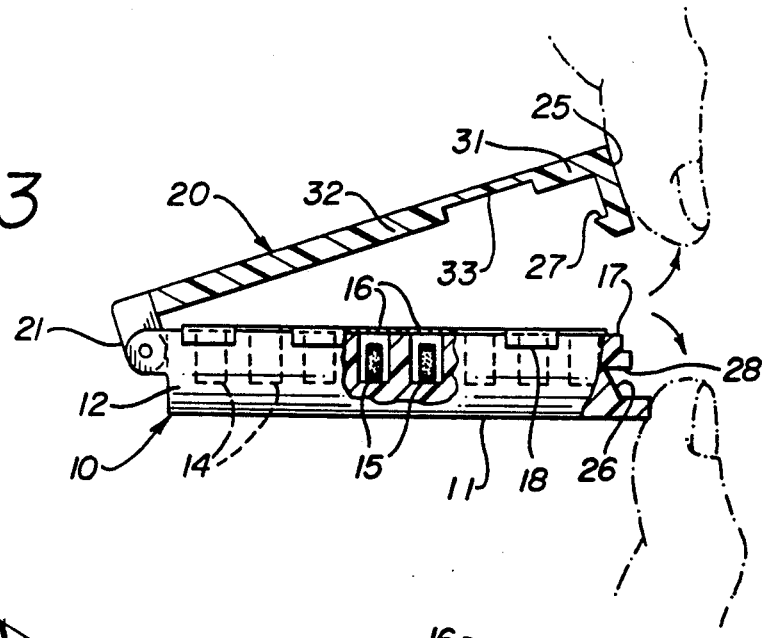
Figure 4:
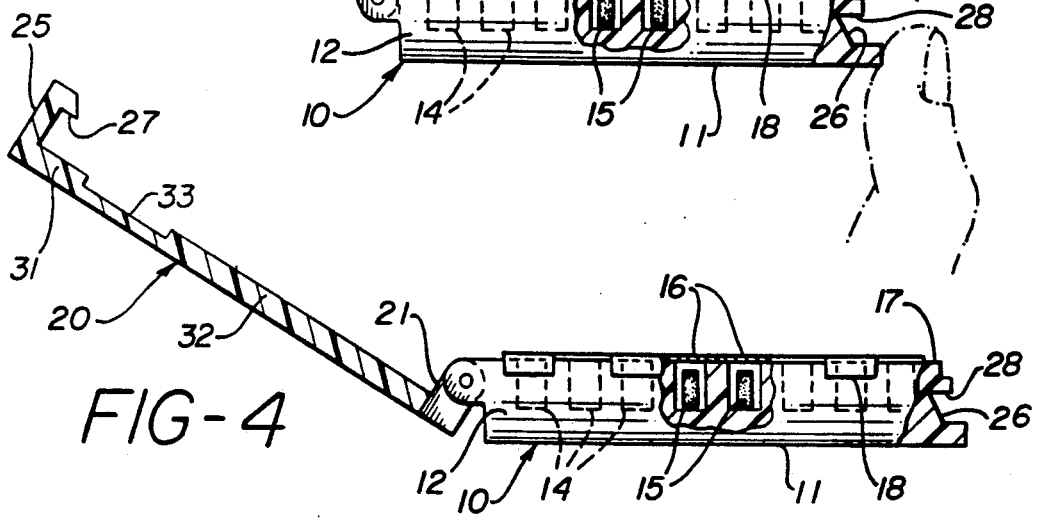
Figure 5:
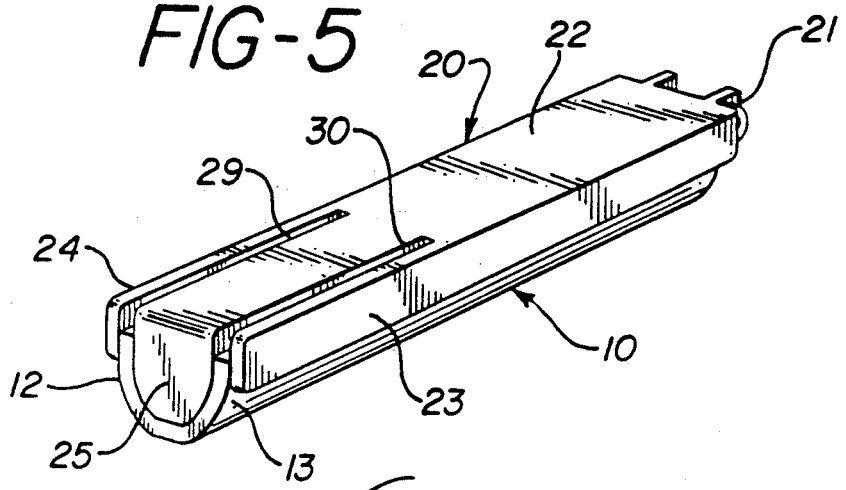
FIGS. 5 and 6 are perspective views of the child resistant unit dosage package of the present invention in closed and open positions, respectively.
Figure 6:
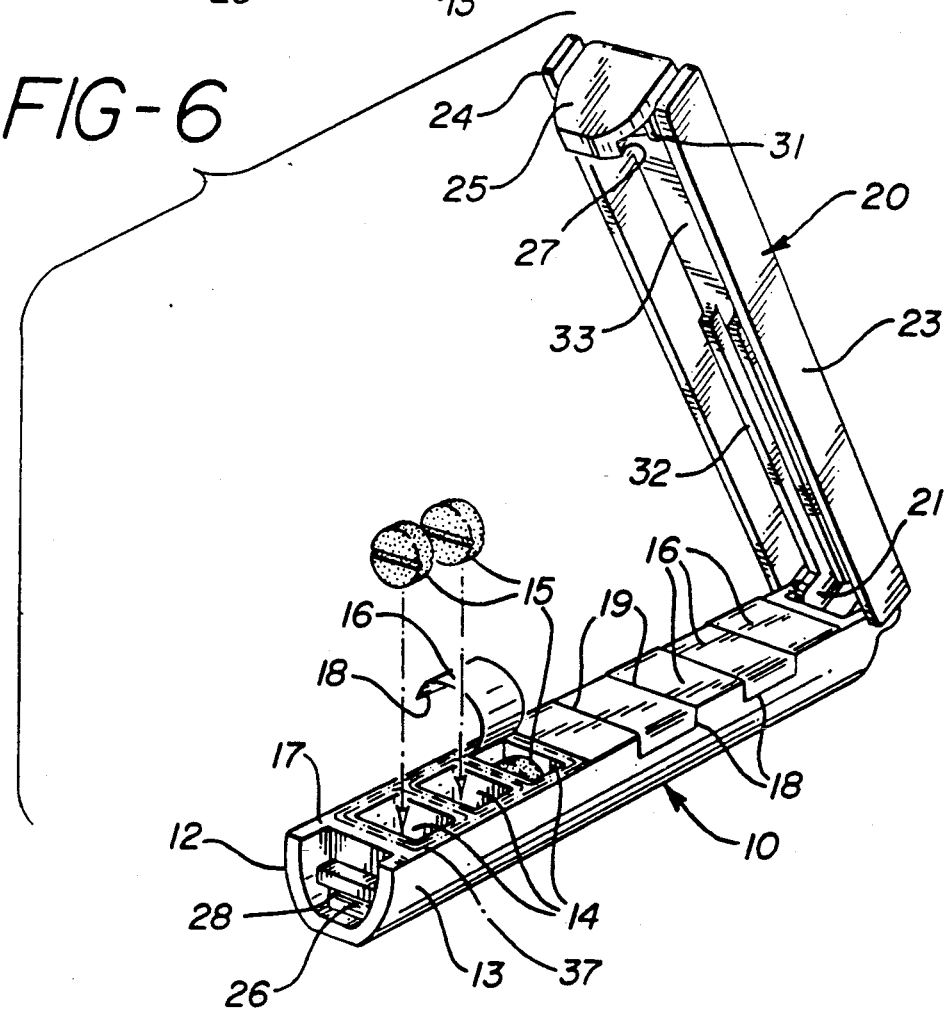

The top 22 of cover 20 is provided with slits 29 and 30 proceeding inwardly from the front edge of cover 20 and terminating before reaching the hinged end. Top 22 is also provided with one or more front reinforcing flanges 31 and rear reinforcing flanges 32. A region 33 between the two flanges 31 and 32 lacks any reinforcing flanges. When the package is closed, it is not apparent that the underside of top 22 is not uniform or that the region 33 is present. Due to the presence of region 33 and also to slits 29 and 30, pressure on region 33 as shown in FIG. 2, disengages interlocking flanges 27 and 28. However, the cover does not swing away from container member 10 due to frictional engagement between front wall 25 and 26 of cover 20 and container member 10, respectively, and between sidewalls 12 and 13 of container member 10 and sidewalls 23 and 24 of cover 20. In order to open the package, it is necessary in addition to hold the front ends of the container member 10 and cover 20 and pull them apart as shown in FIG. 3.

Figure 7:
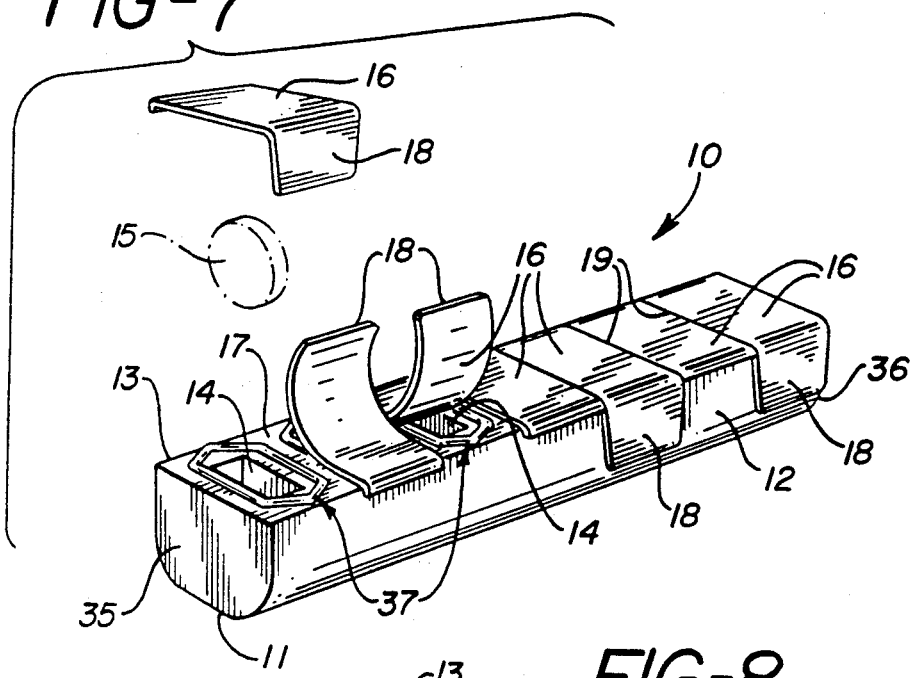
FIG. 7 is an exploded perspective view of another embodiment of the drug container without a cover.

In a further embodiment, the drug container of the invention is provided without a locking cover means as shown in FIG. 7. From FIG. 7, it can be seen that this embodiment of the drug container 10 has an elongated, generally rectangular body with opposed, upwardly projecting end walls 35, 36 having clean planar surfaces. That is, end walls 35, 36 do not carry the hinge means (21) or flange (27) shown in the embodiments of FIGS. 1–6.

Extending upwardly from the top, planar surface 17 and circumscribing the perimeter of each chamber or cavity 19 is a raised crown or crest 37. By providing the raised crown or crest 37, several shortcomings in applying the heat-sealed laminate foil 16 to the container 10 are overcome or minimized and subsequent removal of the tabs 18 is facilitated.

For example, articles produced from typical plastic molding operations have what appear to an observer to be "flat" surfaces, but which contain undulations and are not truly flat. These undulations result from slight temperature fluctuations that are inherent in most plastic molding operations. As a result, heat-sealing of the laminate foil 16 to cover the cavities 14 can result in a non-uniform seal. If this non-uniform seal is present at or adjacent to a cavity 14, the medicinal unit dose tablet 15 can be exposed to a potentially harmful atmosphere or environment that could alter the integrity of the tablet 15.

By providing raised crowns or crests 37, this non-uniformity is eliminated or minimized as the aluminum foil laminate strip 16 is heat sealed to the upper surfaces of the crests 37. Since the upper surfaces of the crests 37 represent a substantially reduced surface area of contact, complete adhesion of the aluminum foil cover strip 16 over each cavity 14 is assured thereby maintaining the integrity of the unit dose tablets 15. Heat-sealing "dwell time" is also substantially reduced with the decreased upper surface area of crests 37 resulting in increased productivity and decreased production costs.

An additional user benefit also results from raised crowns or crests 37 as it is easier and requires less effort and force for a user to remove the protective cover strip 16 due to the significantly reduced area of adhesion between the upper surfaces of crests 37 and the protective cover strip 16.

To further facilitate the removal of protective cover strip 16, it is preferred that at least that portion of the raised crown or crest 37 adjacent a tab 18 be in the form an elongated segment. This makes it easier for a user to grasp the tab 18 for removal of the protective strip 16.

Figure 8:
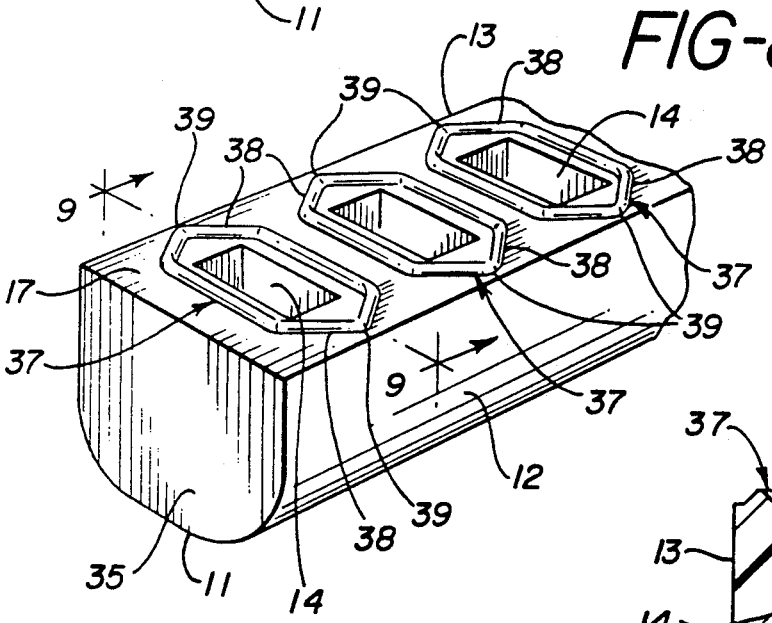
FIG. 8 is a detailed view of a portion of the drug container shown in FIG. 7.
Figure 9:
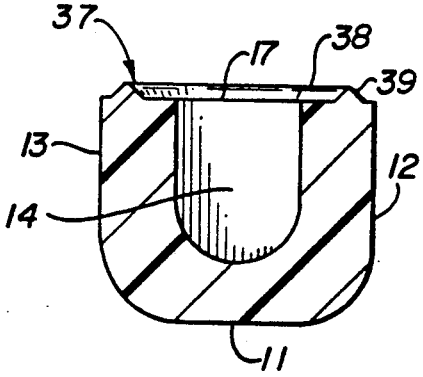
FIG. 9 is a sectional view of the drug container shown in FIG. 8 taken substantially on the line 9—9 of FIG. 8.
Figure 10:
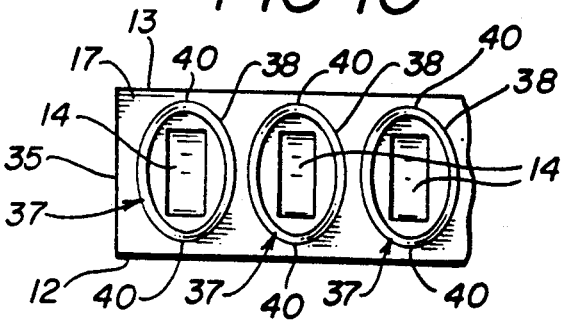
FIG. 10 is a top view showing details of another embodiment of the drug container of FIG. 7.

This preferred feature is illustrated in FIG. 8 where it can be seen that the portions of raised crests 37 adjacent side walls 12 and 13 are formed into elongated segments 38 that end in points 39. In this embodiment, the geometric configuration of crests 37 is shown in the form of an hexagonal. However, the geometric configuration of the crests 37 is not critical and they can be provided in other geometric forms such as oval and elliptical as illustrated in FIG. 10 where the elongated segments 38 of crests 37 are shown terminating in reduced blunt ends 40.

These raised crowns or crests 37 can also be provided in the child resistant package described above and illustrated in FIGS. 1–6 as shown in phantom in FIG. 6.

Figure 11:
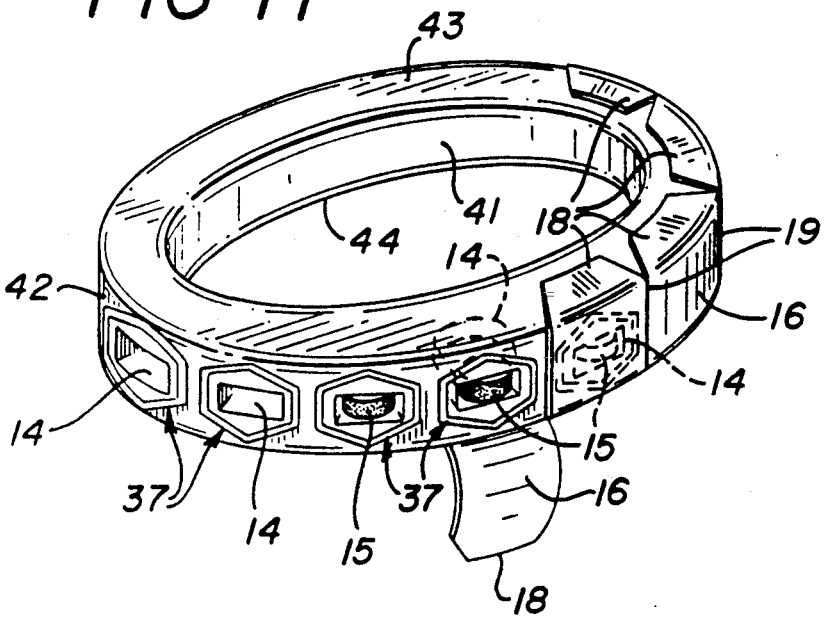
FIG. 11 is a perspective view illustrating another form of the drug container of FIG. 7.
Figure 12:
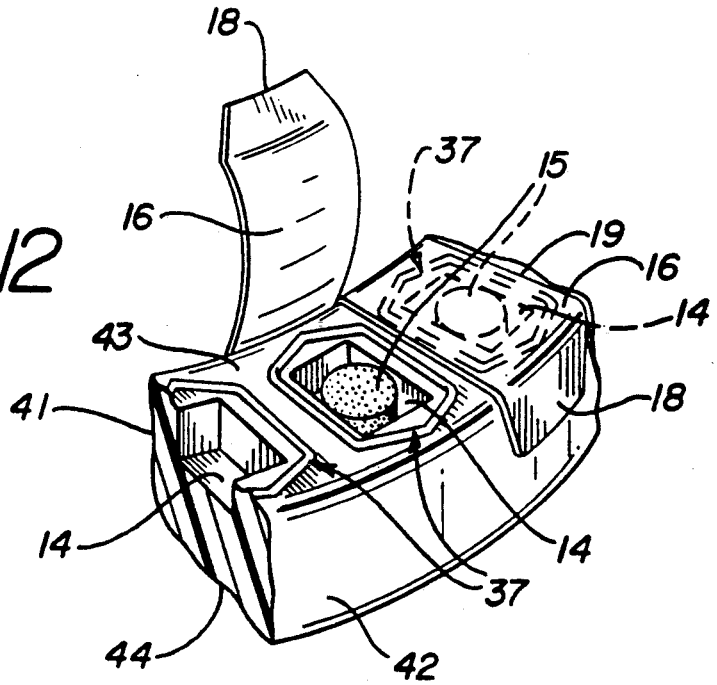
FIG. 12 is a view similar to FIG. 11 showing a fragmentary portion of another embodiment of the container of FIG. 11.

The embodiment of the drug container of the invention illustrated in FIGS. 7–10 has been shown in the form of an elongated, generally rectangular body or "drug stick." However, the drug container of the invention can also be provided in other geometric forms or shapes such as the "do-nut" or "bracelet" forms illustrated in FIGS. 11 and 12. As shown in FIG. 11, the drug container has a first or inner circular band 41 and a second or outer circular band 42 spaced from and substantially concentric to the inner band 41. Inner band 41 and outer band 42 are interconnected by means of opposed, top and bottom walls 43, 44, respectively, which are also in the form of circular bands.

In the embodiment shown in FIG. 11, the cavities or chambers 14 for the tablets 15 are provided in outer circular band 42 between top and bottom walls 43 and 44. In the embodiment shown in FIG. 12, the cavities or chambers 14 for the tablets 15 are provided in top wall 43 between inner and outer circular bands 41 and 42.

In both of the embodiments shown in FIGS. 11 and 12, the raised crown or crest 37 is provided around the periphery of each of the cavities 14 and the protective strip 16 containing scores 19 and tabs 18 is heat-sealed over the cavities 14.

The unit dose package and drug container of the present invention can be made of many suitable materials but moldable plastic is preferred. Polyethylene, either low or high density, can be used as can polypropylene. For cost considerations, low density polyethylene is preferred.

What is claimed is:

1. A unit dosage drug container comprising:

(a) an elongated, generally rectangular body having opposed top and bottom walls, opposed side walls and opposed end walls;

(b) a plurality of cavities defined in said body and accessible through openings formed in said top wall;

(c) a raised crown or crest extending upwardly from the planar surface of said top wall and circumscribing the perimeter of each of said cavity openings, that portion of said crown or crest adjacent a side wall of said container being in the form of an elongated segment that terminates in a point; and, (d) a peelably removable protective strip overlying the top wall and said cavities, said protective strip having a plurality of spaced scores formed therein aligned to be disposed between each of said cavities, said protective strip having a tab formed in the area between each of said cavities to facilitate removal of that portion of said protective strip overlying a cavity.

2. A unit dosage drug container comprising:

(a) a generally circular body having an inner circular band, an outer circular band spaced from said inner band and opposed top and bottom circular side walls;

(b) a plurality of cavities defined in said body and accessible through openings formed in said outer circular band;

(c) a raised crown or crest extending outwardly from the planar surface of said outer circular band and circumscribing the perimeter of each of said cavity openings; and, (d) a peelably removable protective strip overlying said cavities.

3. The unit dosage drug container of claim 2 wherein that portion of said raised crown or crest adjacent a side wall of said container is in the form of an elongated segment.

4. The unit dosage container of claim 3 wherein said elongated segment terminates in a point.

5. The unit dosage container of claim 2 wherein a plurality of spaced scores are formed in said protective strip and are aligned to be disposed between each of said cavities, said protective strip having a tab formed in the area between each cavity to facilitate removal of that portion of said protective strip overlying a cavity.

6. The unit dosage container of claim 2 wherein the cavities defined therein are accessible through openings formed in one of said side walls.

7. A unit dosage drug container comprising:

(a) a generally circular body having an inner circular band, an outer circular band spaced from and concentric to said inner band and opposed top and bottom circular side walls;

(b) a plurality of cavities defined in said body and accessible through openings formed in said outer circular band;

(c) a raised crown or crest extending outwardly from the planar surface of said outer circular band and circumscribing the perimeter of each of said cavity openings, that portion of said crown or crest adjacent a side wall of said container being in the form of an elongated segment; and, (d) a peelably removable protective strip overlying said outer band and said cavities, said protective strip having a plurality of spaced scores formed therein aligned to be disposed between each of said cavities and a tab formed in the area between each of said cavities.

8. The unit dosage drug container of claim 7 wherein said elongated segment terminates in a point.

9. The unit dosage drug container of claim 7 wherein the cavities defined therein are accessible through openings formed in one of said side walls.

10. In a unit dosage package comprising:

(a) a container member adapted to receive medication in dosage form, said container member having:

(i) opposed, upwardly extending side walls;

(ii) opposed, upwardly extending front and rear walls; and, (iii) an outwardly projecting flange on said front wall; and, (b) a cover member sized to fit over said container member and having:

(i) a downwardly extending rear wall hingeably secured to the upwardly extending rear wall of said container member;

(ii) a downwardly extending front wall opposed to said downwardly extending rear wall and having an inwardly projecting flange adapted to engage the outwardly projecting flange on the front wall of said container member in interlocking relationship, said interlocking relationship being concealed when said container member and said cover member are closed and secured to each other by said interlocking relationship;

(iii) opposed, downwardly extending reinforcing flanges which partially overlap the opposed, upwardly extending side walls of said container member, said reinforcing flanges being interrupted to define a non-reinforcing area;

(iv) opposed peripheral slits extending inwardly from the front edge of said cover member in the area substantially common with said non-reinforcing area, said peripheral slits and said non-reinforcing area together forming a flexing region in said cover member such that when pressure is applied to said flexing region, said outwardly and said inwardly projecting flanges become disengaged permitting said cover member to be rotated to open said dosage package;

(c) a plurality of cavities defined in said container member to receive said medication in dosage form; and, (d) peel-away protective strips covering said cavities; the improvement comprising:

(e) a raised crown or crest extending upwardly from the planar surface of the top wall of said container member and circumscribing the perimeters of each of said cavities.

11. The unit dosage package of claim 10 wherein that portion of said raised crown or crest adjacent a side wall of said container member is in the form of an elongated segment.

12. The unit dosage package of claim 11 wherein said elongated segment terminates in a point.

* * * * *